United States Patent [19]

Wüsthof et al.

[11] 4,411,607

[45] Oct. 25, 1983

[54] INTERNAL GEAR MACHINE WITH ROTARY PRESSURE BALANCED VALVE DISC

[75] Inventors: Peter Wüsthof; Johann Schneider, both of Lohr, Fed. Rep. of Germany

[73] Assignee: G. L. Rexroth GmbH, Lohr, Fed. Rep. of Germany

[21] Appl. No.: 254,385

[22] Filed: Apr. 15, 1981

Related U.S. Application Data

[63] Continuation-in-part of Ser. No. 84,114, Oct. 12, 1979, abandoned.

[30] Foreign Application Priority Data

Apr. 23, 1980 [DE] Fed. Rep. of Germany ..... 3015551

[51] Int. Cl.[3] ..... F04C 2/113; F04C 15/00

[52] U.S. Cl. ..... 418/61 B; 418/75; 418/79

[58] Field of Search ..... 418/61 B, 75, 77, 79

[56] References Cited

U.S. PATENT DOCUMENTS 3,289,542 12/1966 Fikse ..... 418/61 B
3,597,128 8/1971 Venable et al. ..... 418/61 B
3,895,888 7/1975 Roberts ..... 418/61 B

FOREIGN PATENT DOCUMENTS 696180 11/1979 U.S.S.R. ..... 418/61 B

*Primary Examiner*—John J. Vrablik
*Attorney, Agent, or Firm*—Michael J. Striker

[57] ABSTRACT

A hydraulic internal gear machine includes a positive displacement unit for working liquid constituted by a rotary outer gear and an inner gear surrounding the outer gear and being in mesh therewith at one point to define a plurality of increasing liquid displacement chambers. The chambers are laterally bounded by a rotary disc which cooperates with a stationary control plate. The disc and the control plates are formed respectively with flow control openings for admitting pressure liquid into a half of the chambers and for discharging the liquid from the other half of the number of chambers. To compensate for the tilting moment acting on the rotary disc, the interface between the rotary disc and the control chamber is provided with arcuate recessed sections communicating with the openings in the rotary disc to apply pressurized liquid in the displacement chambers against both sides of the rotary disc.

5 Claims, 8 Drawing Figures

INTERNAL GEAR MACHINE WITH ROTARY PRESSURE BALANCED VALVE DISC

CROSS-REFERENCE-TO-RELATED-APPLICATION

This application is a continuation-in-part of our pending patent application Ser. No. 84,114, filed on Oct. 12, 1979, now abandoned.

BACKGROUND OF THE INVENTION

The present invention relates in general to a hydraulic internal gear machine of the type having a housing defining an intake port and a discharge port, a fluid displacement unit arranged in the housing, an outer gear supported for rotation about a central axis, an inner gear ring in a sliding engagement with the outer gear and supported for performing a wobbling movement in the housing about the center axis, the inner and outer gears defining a plurality of variable chambers therebetween; a flow control means including a rotary discs arranged for rotation at the same speed as the outer gear, one side of the disc forming a lateral boundary wall for the chambers, the rotary disc having a plurality of first openings communicating with the interstices between the teeth of the outer gear and having control edges at the other side of the disc, a stationary control plate adjoining the other side of the disc and being provided with a plurality of second openings cooperating with the control edges of the first openings, a part of the second openings communicating with the intake port and the other part of the second openings communicating with the discharge port.

When a machine of this kind is connected to a source of pressure fluid to convert its energy, about a half of the consecutive variable chambers resulting between the teeth of the inner and outer gears is under pressure whereby the side of the control plate adjoining the outer gear is subject to kidney-shaped or spheroid 1-shaped pressure field. The control openings in the rotary disc and in the stationary control plate are symmetrically distributed between the center axis and the periphery of the disc and of the control plate.

Approximately the entire periphery of the rotary disc is uniformly exposed to pressure fields. Due to the fact that different pressure fields build up on the side of the rotary disc adjoining the outer gear, the resulting pressure forces act eccentrically on the side of the disc adjoining the outer gear and concentrically on the opposite side when related to the center axis of the rotary disc. As a consequence, the rotary disc is subject to a tilting movement which has to be taken up by the housing and by the displacement unit. The rotary disc therefore within the limits of its play adjusts itself aplicably between the two parts of the machine whereby both the mechanical friction and the accompanying wear is increased and the volumetric efficiency of the machine due to uneven geometric play is impaired.

SUMMARY OF THE INVENTION

It is, therefore, a general object of the present invention to overcome the aforementioned disadvantages.

More particularly, it is an object of the invention to provide an improved internal gear machine of the above-described type wherein the tilting movement acting on the rotary control disc is substantially reduced or avoided.

In keeping with this object and others which will become apparent hereafter, one feature of the invention resides, in an internal gear machine of the aforedescribed kind, in the provision of a plurality of arcuate recessed sections formed in the interface between the rotary disc and the control plate in the region between the first and second openings whereby each of the recessed sections communicates with the first openings in the rotary disc. By virtue of the arcuate recessed sections, pressure fields resulting in the plane between the rotary disc and the control plate are displaced in such a manner that an eccentric resultant pressure action is generated which corresponds approximately to the eccentric pressure acting on the side of the rotary discs adjoining the outer gear. As a consequence, the rotary disc is subject to counteracting forces which either substantially reduce or avoide the aforementioned tilting movement thus producing a higher degree of mechanical and volumetric efficiency. At the same time, wear of the rotary disc is completely removed or substantially reduced.

In the preferred embodiment, the arcuate recessed sections are formed in the rotary disc and are permanently connected by connection grooves with the assigned first openings. In a modification, the arcuate recessed sections are formed in the stationary control plate and communicate via radially extended grooves in the rotary disc with the first openings.

The novel features which are considered as characteristics of the present invention are set forth in particular in the appended claims. The invention itself, however, both as to its construction and its method of operation together with additional objects and advantages thereof will be best understood from the following description of specific embodiments when read in connection with the accompanying drawing.

DESCRIPTION OF THE PREFERRED EMBODIMENTS

Figure 1:
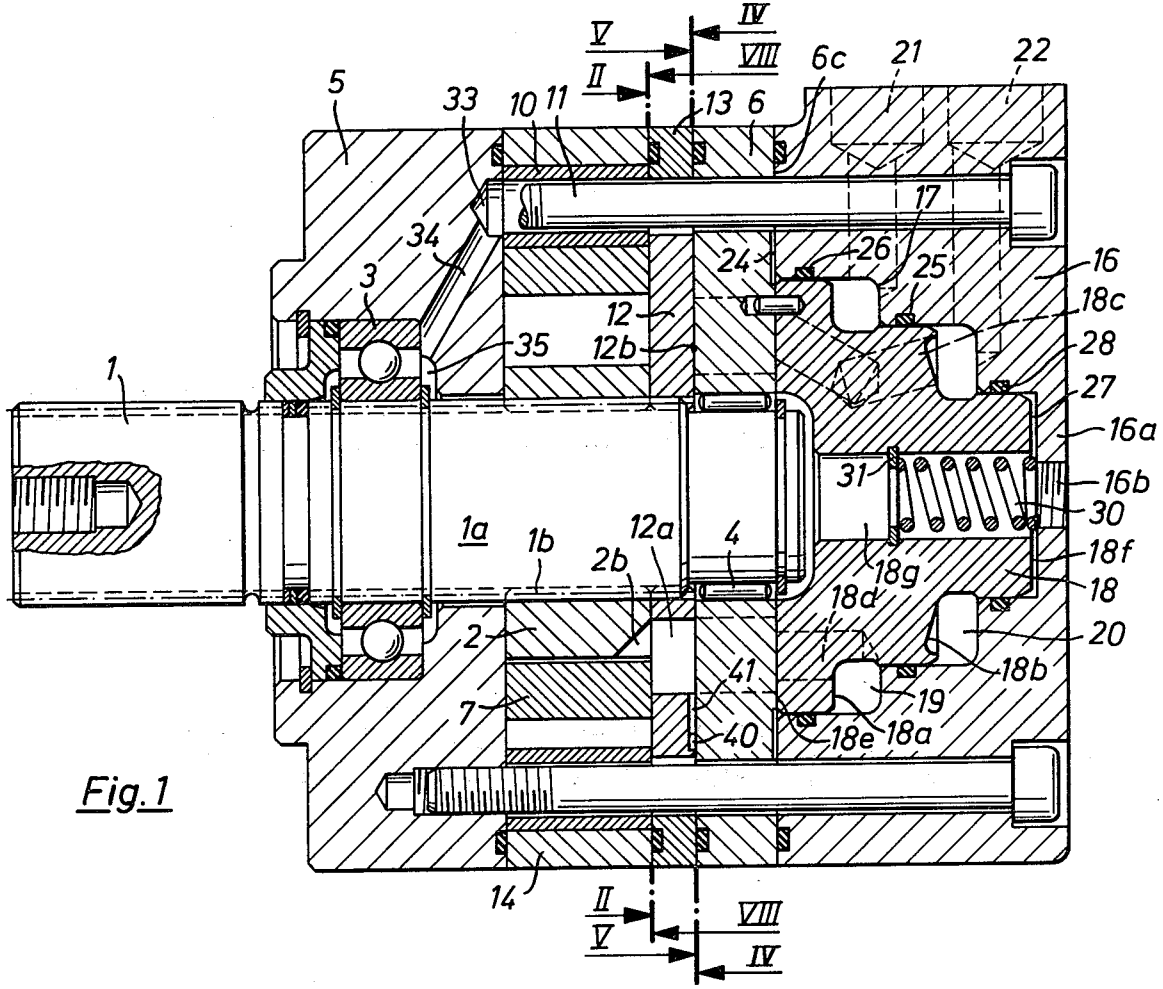
FIG. 1 is an axial section of the internal gear machine of this invention.
Figure 8:
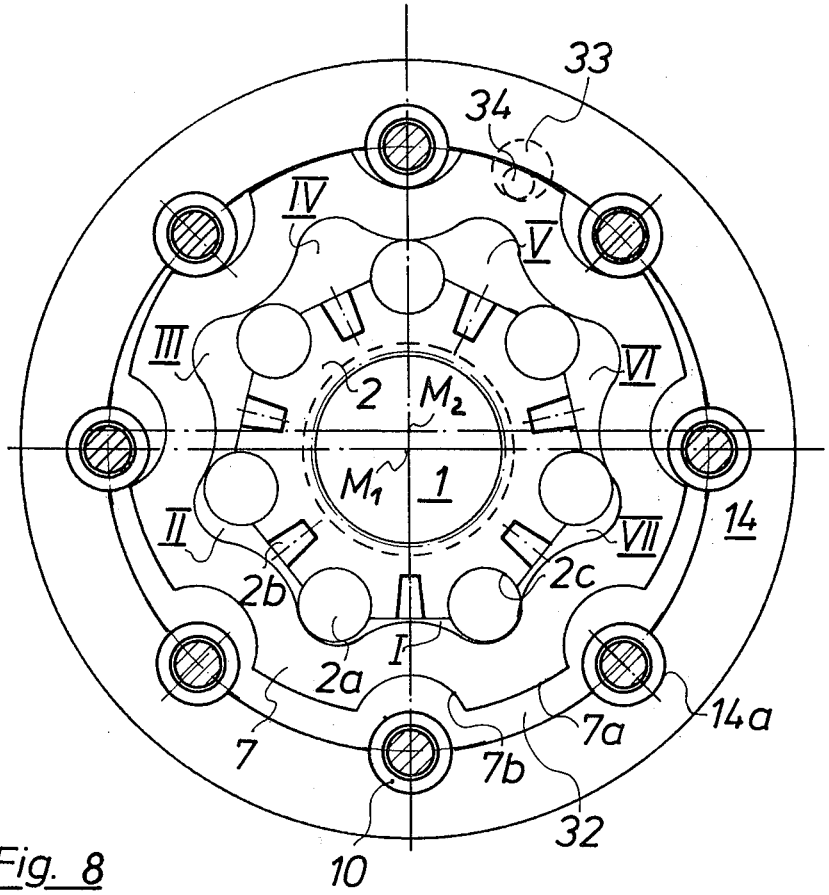
FIG. 8 is a section taken along the line VIII—VIII of FIG. 1.

In FIG. 1, reference numeral 1 denotes a rotary shaft which in its central region 1*a* is provided with splines 1*b* engaging for joint rotation an outer gear 2. Shaft 1 is supported for rotation in housing parts 5 and 6 of the machine on ball bearing 3 and roller bearing 4. An inner gear ring 7 surrounds the outer gear 2 and forms therewith a fluid displacement unit. Teeth 2*a* of outer gear 2 are in the form of rollers which continuously engage at one point the inner gear 7 in such a manner as to form a plurality of increasing pockets or chambers I–VII therebetween (FIG. 8). Roller teeth 2*a* are rotatably supported in corresponding semi-cylindrical recesses 2*c* of the outer gear 2. The inner ring 7 has on its outer periphery 7*a* similar semi-cylindrical recesses 7*b* which periodically engage juxtaposed buffer rollers 10 which are uniformly distributed on the inner wall of cylindrical housing part 14. The inner diameter of the housing part 14 is slightly larger than the outer diameter of inner gear ring 7 and the radius of the semi-cylindrical recesses 7*b* is larger than the radius of buffer rollers 10. As a consequence, inner gear 7 is free to perform a wobbling movement along the inner wall of the housing part 14 and its central point $M_2$ moves on a circular path around the center axis $M_1$ of the outer gear 2.

A rotary disc 12 is splined on shaft 1 between the housing part 6 and the fluid displacement units 2 and 7. Axial play of the rotary disc 12 is limited by a spacer ring 13 disposed between the housing part 6 and the cylindrical housing part 14. The part 14 which encloses the fluid displacement unit has its inner wall provided with semi-cylindrical recesses 14*a* for accommodating the aforementioned buffer rollers 10. The rotary disc 12 engages the same splines 1*b* on the rotary shaft as does the outer gear 2 and consequently gear 2 and disc 12 rotate at the same speed. The radius of the rotary disc 12 exceeds the inner radius of the outer gear ring 7 so that disc 12 forms a lateral boundary wall for the displacement chambers I–VII. Rotary disc 12 is formed with a plurality of flow control openings 12*a* uniformly distributed so as to communicate with the interstices between the teeth 2*a* of the outer gear 2. The flow control opening 12*a*, at the side 12*b* of the rotary disc which is remote from the outer gear 2, is formed with radially directed control edges 12*a*1 and 12*a*2. These control edges cooperate with corresponding control openings 6*a* and 6*b* formed in an adjoining control plate 6. The control openings 6*a* and 6*b* exceed in number the flow control openings 12*a* in the disc 12 whereby a set of alternating openings 6*a* in this example is connected to a source of pressure fluid and the set of alternating control openings 6*b* is connected to a tank or vice versa, depending of the desired direction of rotation of the shaft 1. The root circle of outer gear 2 coincides approximately with a half of the radial extension of the control edges 12*a*1 and 12*a*2 of the flow control openings in the rotary disc. In the range of the overlapping part of the flow control openings 12*a*, the adjoining face of the outer gear 2 is formed with radial grooves 2*b* for guiding working fluid from the inlet openings into the displacement unit. The housing cover 16 which adjoins the stationary control plate 6 has a stepped central recess 17 which accommodates a correspondingly stepped axial plunger 18. Annular flanges 18*a* and 18*b* of the plunger 18 delimit together with the stepped bore 17 annular spaces 19 and 20 communicating respectively with an intake channel 21 connectable to the source of pressure, and with a discharge channel 22 connectable to a tank. Channels 18*c* and 18*b* in the plunger 18 lead respectively from flanges 18*a* and 18*b* and connect the annular spaces 19 and 20 to respective sets of the control openings 6*a* and 6*b* in the control plate 6. Depending on the connection of the source of pressure liquid to one of the annular spaces 19 and 20, either the annular surface 18*a* or the annular surface 18*b* is attacked by pressure liquid. The resulting pressure is transmitted to the bottom end face 18*e* of plunger 18 and therefrom to the outer face 6*c* of the stationary control plate 6. As a consequence of the applied pressure against the face 6*c*, any deflection of the plate 6 toward the housing cover 16 which might be caused by the pressure fluid in the displacement unit, is effectively prevented. The size of ring surfaces 18*a* and 18*b* corresponds approximately to the area on the rotary disc 12 which is laterally attacked by pressure fluid in the displacement chambers I–VII. The annular spaces 19 and 20 are hermetically sealed one from the other by a seal ring 25, and from the annular gap 24 between the collar 16 and the control plate 6, by the sealing ring 26. The annular space 20 in addition is sealed by a sealing ring 28 from the interspace 27 between the cover plate 16*a* and stepped face 18*f* of the plunger 18. Plunger 18 is provided with a central passage 18*g* through which any leaking liquid which may occur during the operation of the machine flows toward a leakage liquid outlet 16*b* in the cover plate 16*a*. The central passage 18*g* at the same time accommodates a pressure spring 30 resting at one end thereof on the cover plate 16*a* and at its other end on a snap ring 31 thrusts plunger 18 against the stationary control plate 6.

Leaking liquid penetrating into the interspace 32 between the inner gear 7 and the inner wall of housing part 14 is discharged into a collecting chamber 33 having the form of a blind bore in the wall of housing 14. From the blind bore the leaking liquid is discharged via a connection passage 34 in the housing part 5 into an annular bearing space 35 communicating with the ball bearing 3 and therefrom is fed via splines 1*b* on the shaft 1 through roller bearing 4 into the central passage 18*g* of the plunger 18. One half of the number of displacement chambers I–VII is always exposed to pressure of working fluid whereas the other half is pressure released through the connection to the tank. Accordingly, the same pressure conditions are applied on the adjoining side of rotary disc 12.

Figure 2:
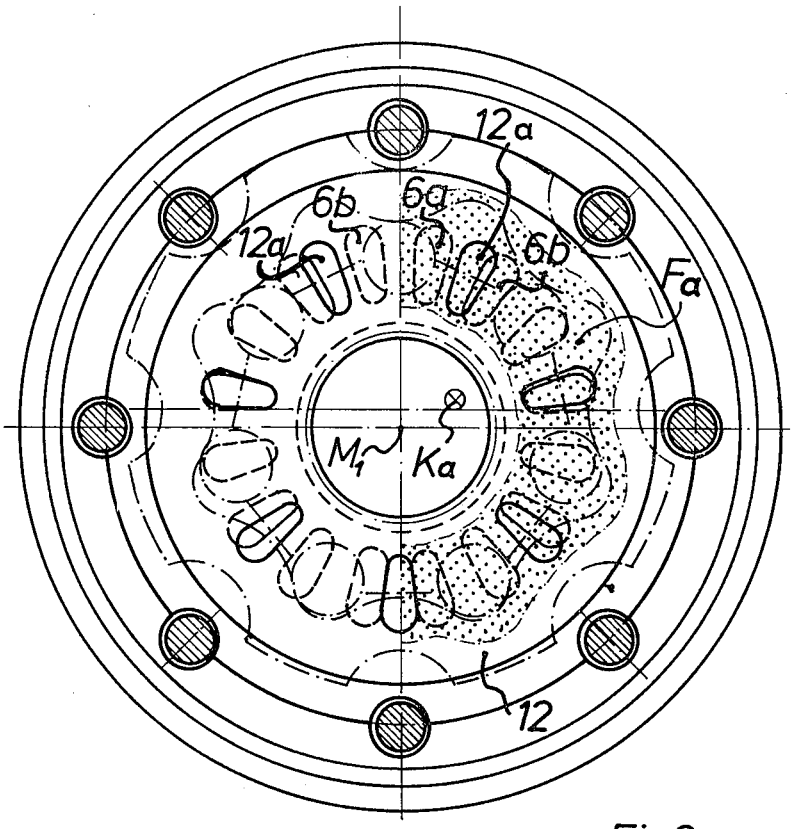
FIG. 2 is a transverse section taken along the line II—II of FIG. 1.

In FIG. 2 illustrating in a front view the rotary disc 12 with its flow control openings 12*a* at the side adjoining the fluid displacement unit, the surface portion $F_a$ exposed to the working pressure is indicated by dotted area. The resulting point of force application is indicated by $K_a$. This application point is situated outside the center axis $M_1$ and therefore, moves on a circular path similarly as the center of the inner gear 7. The opposite side 12*b* of the rotary disc, namely the side provided with the controlling edges, is exposed to pressure of working liquid which is uniformly distributed over the entire annular surface portion juxtaposed to the uniformly distributed control openings 6*a* and 6*b* in the control plate 6.

Figure 3:
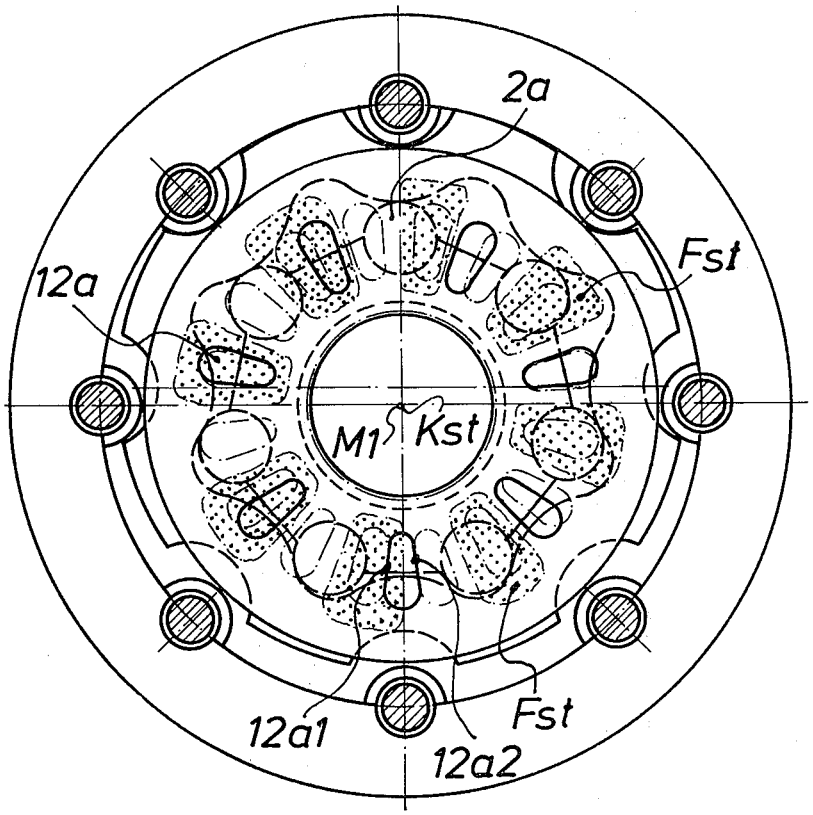
Fig.3 PRIOR ART
FIG. 3 is a transverse section of a prior-art machine similar to that of FIG. 4.

FIG. 3 illustrates in a front view the side of the rotary disc 12 adjoining the control plate 6, and the annular surface portion $F_{st}$ exposed to uniformly distributed pressure fluid is also indicated by a dotted area. The resulting force acts in a point $K_{st}$ which coincides with the rotary axis $M_1$ of the disc 12.

Figure 4:
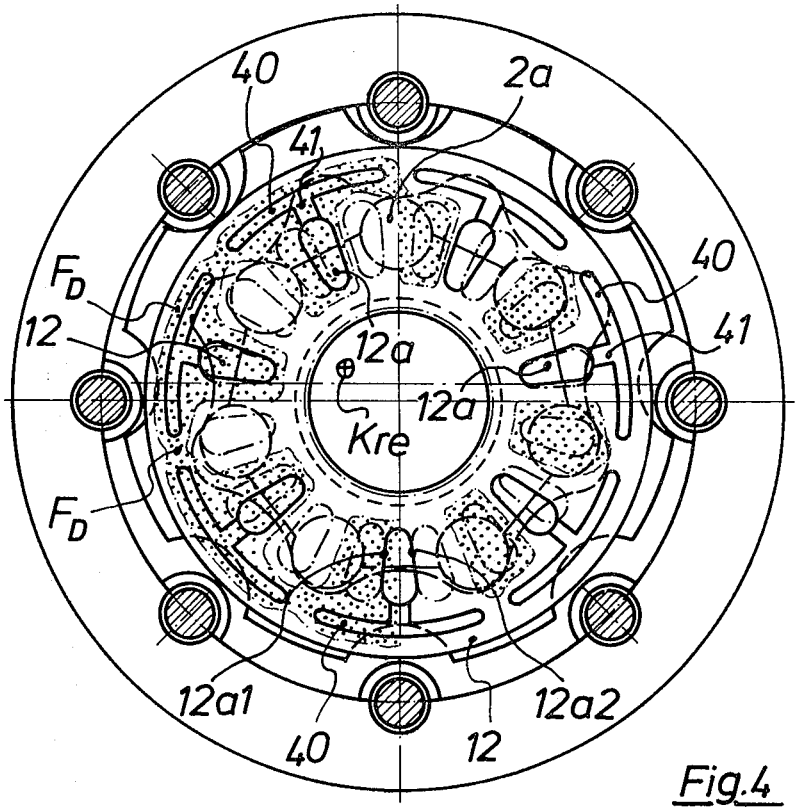
FIG. 4 is a sectional view taken along the line IV—IV in FIG. 1.

In FIG. 4 which illustrates the same view of the rotary disc 12 as FIG. 3, the fluid controlling side of the rotary disc 12 is provided near its circumference with a plurality of arcuate recessed sections 40 each communicating via a connection groove 41 with an assigned flow control opening 12*a*. These arcuate grooves 40 together with the connection groove 41 are covered by the adjoining surface portion of the stationary control plate 6. As a consequence, in each of the arcuate sections 41 a pressure builds up corresponding to that in the assigned displacement chamber of the displacement unit and consequently in the range of the arcuate sections 40 located on one half of the controlling side of the rotary disc 12 additional areas are created which are exposed to pressure of working liquid. These additional areas $F_D$ are also indicated by dots. In the application point $K_{re}$ a force resulting from these additional pressure surfaces $F_D$ is again offset from the center axis $M_1$ and is situated approximately opposite the force application point $K_a$ acting on the other side of the rotary disc 12. The arcuate grooves are dimensioned such that also the magnitude of the force $K_{re}$ be substantially equal to the force $K_a$. By virtue of this arrangement a counteracting tilting movement is applied on the rotary disc 12 which compensates for the tilting movement introduced by the resultant force $K_a$. Tilting forces and movements acting against respective sides of the rotary disc are thereby substantially balanced and the residual forces and tilting movements which may still be effective on the disc are substantially reduced and cannot affect the mechanical or hydromechanical efficiency of the hydraulic machine.

Figure 5:
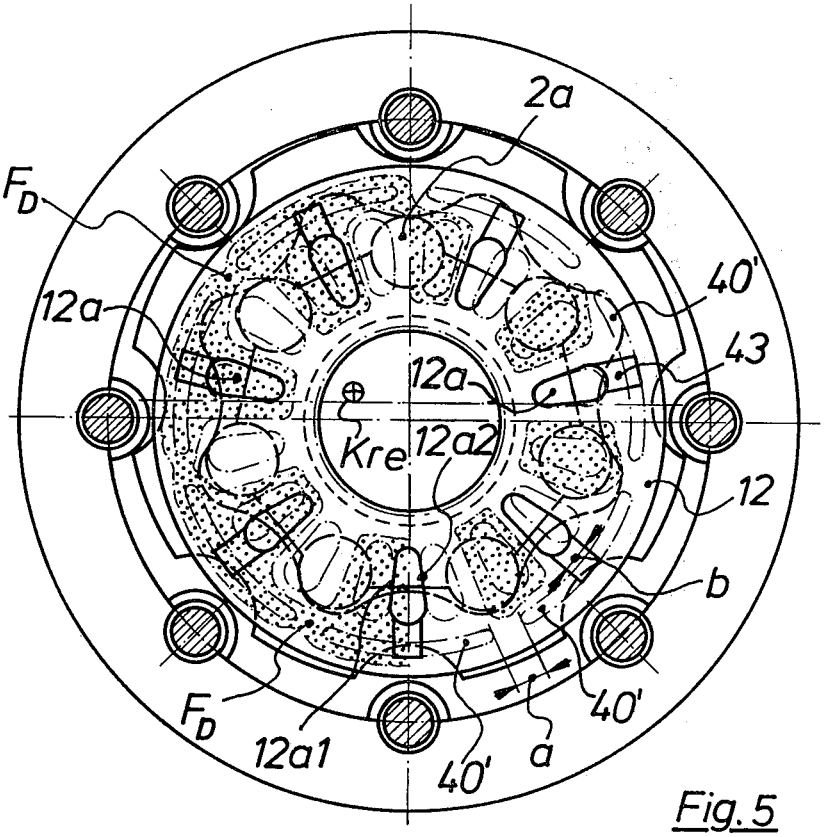
FIG. 5 is a sectional view similar to FIG. 4 of a modified version of this invention.

FIG. 5 illustrates a modification of the hydraulic machine of this invention in which the arcuate recessed sections 40' are formed in the stationary control plate 6 which is covered by the rotary disc 12. The connection between the flow control openings 12*a* in the disc 12 and the arcuate recessed grooves 40' is effected by means of radially directed cutouts 43 formed in the disc 12 and having a width b which is within the limit of clearance a between the opposite tips of adjacent arcuate grooves 40'. In this manner, a simultaneous connection between two cut-outs by a single arcuate groove is effectively prevented.

Figure 7:
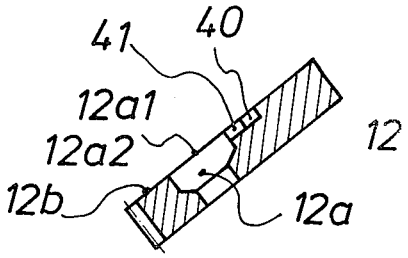
FIG. 7 is a radial section of a portion of the disc according to FIG. 6 taken along the line VII—VII.
Figure 6:
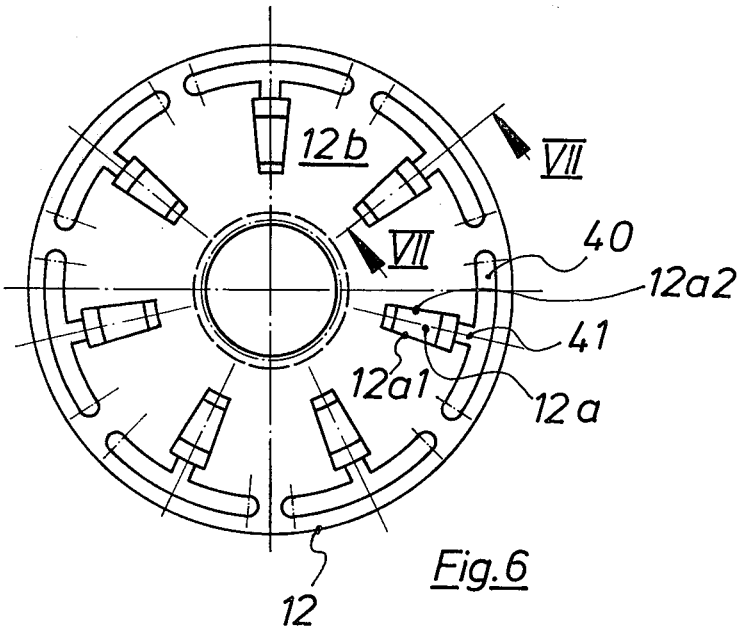
FIG. 6 is a front view of still another modification of flow control openings on the control side of the rotary disc of this invention.

FIG. 6 shows a preferred embodiment of this invention in which the arcuate recessed sections 40 are formed in the controlling side of the rotary disc 12. FIG. 7 illustrates in a sectional view according to line VII—VII in FIG. 6, the relatively small depth of the arcuate section 40 and connection groove 41 with respect to the controlling part of flow control openings 12*a*.

It will be understood that each of the elements described above or two or more together, may also find a useful application in other types of constructions differing from the types described above.

While the invention has been illustrated and described as embodied in a specific example of the internal gear hydraulic machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims:

1. An internal gear hydraulic machine, comprising a housing defining an intake port and a discharge port; a rotary shaft in said housing; a fluid displacement unit arranged in said housing and including an outer gear supported on said shaft for rotation about a central axis thereof; an inner gear in sliding engagement with said outer gear and supported for performing a wobbling movement in said housing about said central axis; said inner and outer gear defining a plurality of variable chambers therebetween; a flow control means including a rotary disc arranged in said housing and mounted on said shaft for rotation at the same speed as said outer gear and one side of said disc forming a lateral boundary wall for said chambers, said rotary disc having a plurality of first openings communicating with the interstices between the teeth of said outer gear and having control edges at the other side thereof remote from said outer gear; a stationary control plate adjoining said other side of the disc and being provided with a plurality of second openings cooperating with said control edges of the first openings, a part of said second openings communicating with said intake port and another part of said second openings communicating with said discharge port; and a plurality of arcuate recessed sections formed in the interface between said rotary disc and said control plate, said arcuate recessed sections communicating with respective first openings to compensate for tilting moments acting on said rotary disc from said variable chambers.

2. A hydraulic machine as defined in claim 1, wherein said arcuate recessed sections are formed in said rotary disc and each section being connected to an assigned first opening by radially directed connection groove.

3. A hydraulic machine as defined in claim 1, wherein said arcuate recessed sections extend substantially in a circumferential direction with respect to said central axis.

4. A hydraulic machine as defined in claim 1, wherein said arcuate recessed sections are formed in said stationary control plate, the adjoining side of said rotary disc being formed with radially directed connection grooves communicating with respective first openings and extending into the range of said arcuate recessed sections in said control plate.

5. A hydraulic machine as defined in claim 4, wherein the width of said connection grooves is less than the clearance between the consecutive arcuate recessed sections.

* * * * *